US006680673B1

(12) United States Patent
Wong

(10) Patent No.: US 6,680,673 B1
(45) Date of Patent: Jan. 20, 2004

(54) REMOTE CONTROL WITH SAFETY FEATURES

(75) Inventor: Philip Lim-Kong Wong, Kettering Northhants (GB)

(73) Assignee: Acumen, Inc., Sterling, VA (US)

( * ) Notice: Subject to any disclaimer, the term of this patent is extended or adjusted under 35 U.S.C. 154(b) by 0 days.

(21) Appl. No.: 09/272,309

(22) Filed: Mar. 19, 1999

Related U.S. Application Data

(60) Provisional application No. 60/078,561, filed on Mar. 19, 1998.

(51) Int. Cl.[7] ..... G08C 17/00

(52) U.S. Cl. ..... 340/825.69; 341/176; 340/825.72

(58) Field of Search ..... 307/115; 379/88.12; 200/400; 340/825.72, 825.69, 825.56; 318/266; 126/512; 236/94; 312/333; 74/470; 361/170, 172; 348/734, 569

(56) References Cited

U.S. PATENT DOCUMENTS 3,838,748 A * 10/1974 Gray et al. ..... 361/170
3,906,369 A * 9/1975 Pitman et al. ..... 340/825.72
4,010,408 A * 3/1977 Bailey ..... 318/266
4,026,263 A * 5/1977 Boyd ..... 126/502
4,233,642 A * 11/1980 Ellsberg ..... 361/172
4,460,125 A * 7/1984 Barker et al. ..... 236/94
4,506,121 A * 3/1985 Peterson et al. ..... 74/470
4,839,533 A * 6/1989 Aga ..... 307/115
4,924,564 A * 5/1990 Shah ..... 126/512
5,654,813 A * 8/1997 Whitworth ..... 340/825.72
5,769,517 A * 6/1998 Carde ..... 312/333
5,883,680 A * 3/1999 Nykerk ..... 348/734
6,426,705 B1 * 7/2002 Wischoeffer ..... 340/825.69

OTHER PUBLICATIONS

Betamax Remote Controller; Remote Control Operation.*

* cited by examiner

*Primary Examiner*—Michael Horabik
*Assistant Examiner*—Hung Dang
(74) *Attorney, Agent, or Firm*—Crowell & Moring LLP

(57) ABSTRACT

A remote control for an operating system such as a fireplace, includes a remote transmitter and a receiver. The remote transmitter communicates signals to the receiver to control the operating system. The remote transmitter includes a child safety switch which, when activated, prevents activation of the receiver by the remote transmitter.

7 Claims, 12 Drawing Sheets

| | LCD 1 | | LCD2 (UTS-A026) | | | |
|---|---|---|---|---|---|---|
| KEY | RC-SMART | RC-SMART W/ FF | SMART STAT WITHOUT MANUAL ON/OFF | SMART STAT WITHOUT MANUAL ON/OFF W/ FF | SMART STAT WITH MANUAL ON/OFF | SMART STAT WITH MANUAL ON/OFF W/ FF |
| S1 | — | — | UP KEY | UP KEY | UP KEY | UP KEY |
| S2 | — | — | DOWN KEY | DOWN KEY | DOWN KEY | DOWN KEY |
| S3 | — | — | TIME SET KEY | TIME SET KEY | TIME SET KEY | TIME SET KEY |
| S4 | — | — | TIME CANCEL KEY | TIME CANCEL KEY | TIME CANCEL KEY | TIME CANCEL KEY |
| S5 | — | — | ON/OFF KEY | ON/OFF KEY | AUTO KEY | AUTO KEY |
| S6 | — | FLAME HEIGHT KEY | — | FLAME HEIGHT KEY | — | FLAME HEIGHT KEY |
| S7 | — | FAN SPEED KEY | — | FAN SPEED KEY | — | FAN SPEED KEY |
| S8 | MANUAL ON/OFF KEY | MANUAL ON/OFF KEY | — | — | MANUAL ON/OFF KEY | MANUAL ON/OFF KEY |

FIG.6C

NOTE: FOR ACUMEN REMOTE CONTROLLER 2
DISPLAY: USE LCD 1 (SAME AS RC SMART)

| KEYS | FUNCTION | CODING |
|---|---|---|
| S1 | HI | 0 0 1 0 |
| S2 | LO | 0 1 0 0 |
| S3 | OFF | 0 1 1 0 |
| S6 | FLAME TOGGLE | 1 1 1 1 |
| S8 | MANUAL ON/OFF | 0 0 0 1 |

FIG.6D

| | |
|---|---|
| JP1 | CONTROL MODE: HEAT (OFF) / COOL (ON) |
| JP2 | RUN MODE : NORMAL (OFF) / TEST (ON) |
| JP3 | SLEEP SELECT: OFF (ENABLE SLEEP)<br>ON (DISABLE SLEEP) |
| JP5 | UNIT: FAHRENHEIT (OFF) / CELSIUS (ON) |
| JP6 | OFF: SMART STAT WITHOUT MANUAL ON/OFF<br>ON: SMART STAT WITH MANUAL ON/OFF |

FIG.6E

| JP8 | JP7 | JP4 | MACHINE TYPE (0:OFF / 1:ON) |
|---|---|---|---|
| 0 | 0 | 0 | ACUMEN REMOTE CONTROLLER 1 LCD 2 |
| 0 | 0 | 1 | HEATER-N-GLO SMART STAT LCD 1 |
| 0 | 1 | 0 | HEATER-N-GLO RC SMART LCD 3 |
| 1 | 0 | 0 | ACUMEN REMOTE CONTROLLER 2 LCD 3 |

FIG.6F

REMOTE CONTROL WITH SAFETY FEATURES

CROSS-REFERENCE TO RELATED APPLICATIONS

This application claims the benefit of prior filed U.S. provisional application Ser. No. 60/078,561 filed on Mar. 19, 1998.

BACKGROUND AND SUMMARY OF THE INVENTION

The invention relates to remote controls and, more particularly, to various safety features included in remote control systems.

The use of remote controls to operate various systems is now quite common. The remote control system includes both a remote transmitter which wirelessly couples with a receiver customarily arranged near or on the system being controlled. The typical remote transmitter includes power on and off switches, as well as a plurality of operating key switches. The remote transmitters can thus be easily operated by actuating the various switches.

One of the most common usages of remote control systems is with respect to the operation of televisions, as well as other consumer electronic equipment such as video cassette recorders, stereo components, etc. However, the use of remote control systems is presently expanding into other operating systems. For example, remote control systems are used to control the actuation of fireplaces, HVAC systems, ceiling fans, and other systems involving wireless communication, the hardware industry, etc. The expansion of remote control usage has, however, generated safety problems in view of the ease of use of remote control systems. These problems stem from the potentially dangerous and unsafe nature of some of the operating systems now employing remote control systems.

There is therefore needed an improved remote control system which can eliminate the above problems in the use of remote control systems.

The present invention solves the above problems by providing a remote control system having a remote transmitter and receiver, wherein various safety features are incorporated into the remote control system. In particular, child safety features are included according to the present invention such that the operation of the remote transmitter can be controlled by a responsible individual in order to prevent inadvertent or accidental actuation of potentially dangerous or unsafe systems.

In one particularly advantageous embodiment, a remote control system for use in activating a fireplace includes a child safety switch enclosed within the housing of the remote transmitter to control the powering of the remote transmitter such that a child could not accidentally switch on the potentially dangerous fireplace system. Further, with such a remote control used to operate a fireplace system, an over temperature circuit is provided at the receiver end of the remote control system in order to turn off the fireplace heater and fan (if present) when a potentially unstable temperature threshold has been crossed. Advantageously, the microcontroller operating in the remote transmitter can restart the temperature control of the fireplace once the over temperature detection circuit indicates that the temperature has again fallen below the threshold value.

Advantageously, the remote control system of the present invention can be applicable to any type of wireless remote control, such as radio frequency, ultrasonic, infrared and others in association not only with the fireplace industry, but also with the hardware industry, HVAC system industry, wireless communication, etc.

Other objects, advantages and novel features of the present invention will become apparent from the following detailed description of the invention when considered in conjunction with the accompanying drawings.

DETAILED DESCRIPTION OF THE DRAWINGS

The present invention will be described with respect to a particular embodiment of the remote control system for use with a fireplace system. Of course, one skilled in the art will recognize that the use of safety features with remote control systems is not limited to the particular embodiment described herein, but can also be applied to any use of a remote control system with respect to an operating system to be controlled.

Referring to the figures, a fireplace remote control system consists of a remote transmitter 10 and a receiver 20. Both the remote transmitter 10 and the receiver 20 are controlled via microprocessor, such as is currently readily used in electronic circuitry. For example, a microprocessor such as an MSM64164 microprocessor 14 (FIG. 6) can be used to control the operation of the remote transmitter in a fireplace system.

Figure 1:
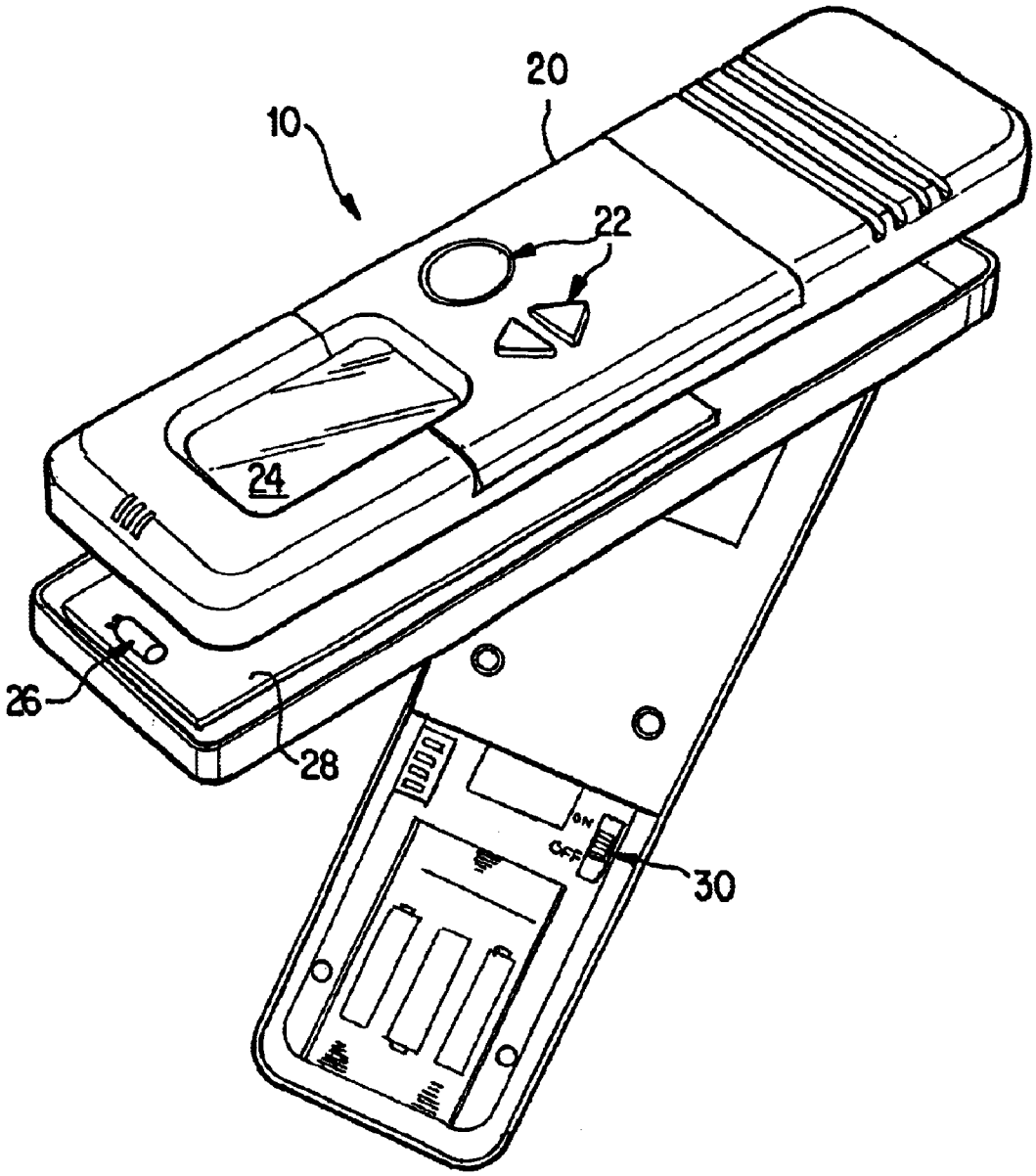
FIG. 1 is an expanded perspective representation of a remote transmitter in accordance with the present invention, the remote transmitter having its cover partially removed and including a representation of its underside.
Figure 2:
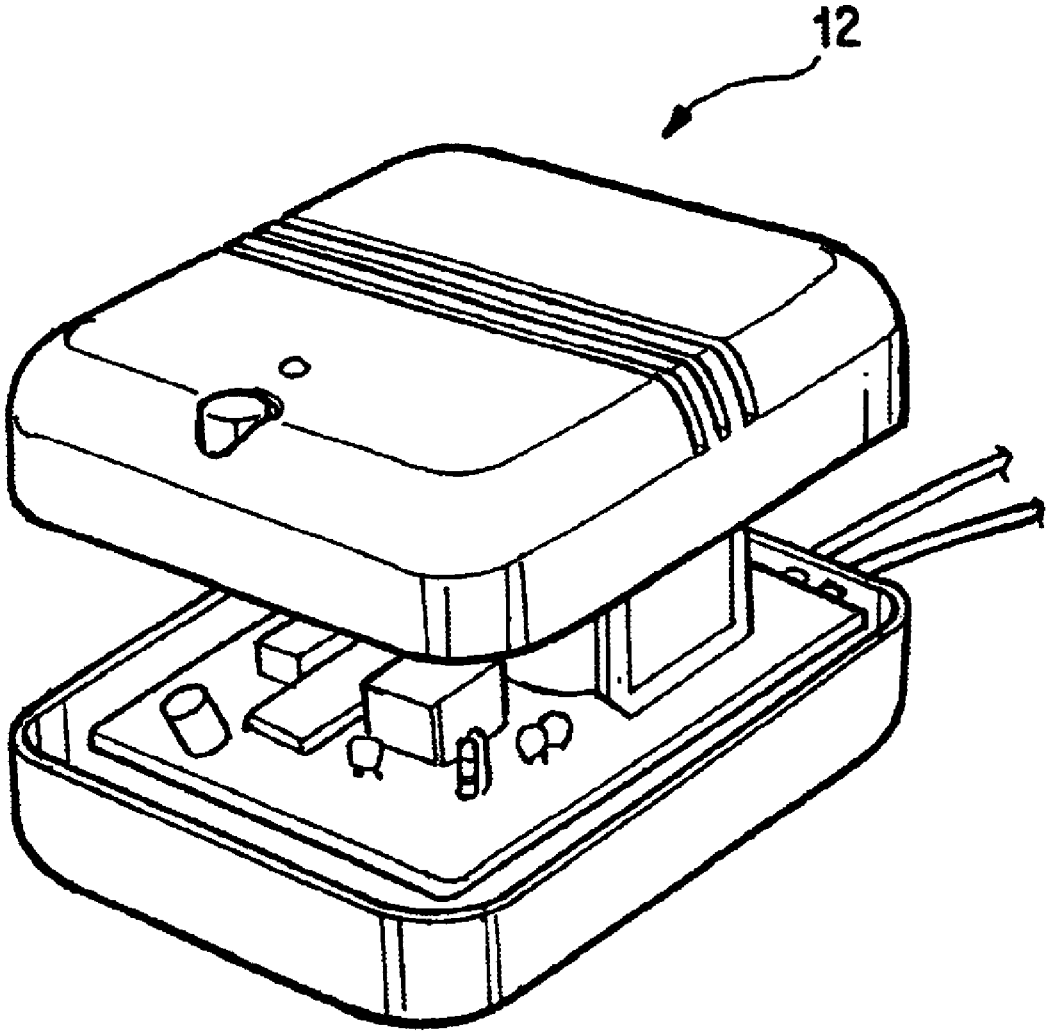
FIG. 2 is an enlarged overall perspective view of a receiver according to the present invention having its cover removed to partially reveal the interior circuit board.

A user of the remote control system sends wireless signals, such as RF signals, via the remote transmitter 10 (FIG. 1) to the receiver 12 (FIG. 2). The receiver 12 receives and decodes the RF signal from the remote transmitter and turns on or off a fireplace heater. In certain preferred embodiments, the receiver 12 will also control the operating speed of a fireplace fan as well as a flame height of the fireplace heater. Of course, other features can also be controlled.

Referring to FIG. 1, the remote transmitter 10 includes a housing 20 on which is arranged the actuating buttons 22 and a display 24. Inside the housing 20, circuitry for operating the remote transmitter is arranged. The circuitry is typically arranged on a printed circuit board 28 fixed in the housing 20. As shown in FIG. 1, the remote transmitter 10 includes a thermistor 26 arranged on a printed circuit board 28. The thermistor senses the ambient temperature and displays it on the display 24, such as an LCD display. When a user presses the manual on/off button 22 on the remote transmitter 10, a microprocessor 14 (FIG. 6) sends on/off command code words via the RF transmitter to the receiver 12. The RF receiver receives the RF signal from the remote transmitter, recovers the transmitted command code and sends the command code to the receiver's microprocessor 16 (FIG. 7). The microprocessor 16 receives the on/off command and turns the heater on and off accordingly.

A user can also select a desired temperature setting and actuate the remote transmitter as a thermostat. When the ambient temperature is, for example, 1° F. above a preset temperature, the remote transmitter will transmit an on command to the receiver to turn on the heater. When, for example, the ambient temperature is 1° F. below the present temperature, the remote transmitter will transmit an off command code to the receiver which turns off the heater. When the user thus uses the remote transmitter as a thermostat, the user can set a timer to limit the operating time (for example, between 1 and 120 minutes) When the timer elapses, for example by counting down to zero, the remote transmitter will automatically transmit an off command to the receiver to turn off the heater. Of course, a timer cancel button can also be activated to cancel the timer.

In a preferred embodiment, a user can also select the heater fan speed by pressing a fan speed button on the remote transmitter. After the desired fan speed is selected by the user, the remote transmitter 10 will automatically transmit the fan speed to the receiver 12. The microprocessor 16 in the receiver can thus output a signal to control the fan speed. Also advantageously, a user can select a flame height, for example, high, medium, low, by pressing a flame height button on the remote transmitter 10. After the desired flame height is selected by the user, the remote transmitter automatically transmits the flame height information signal to the receiver. The microprocessor 16 in the receiver thus sets the flame height in accordance with the user's commands.

The microprocessor 16 in the receiver also stores the fan speed and flame height settings received from the remote transmitter. The storage can be performed in the microprocessor's internal memory.

The receiver 12 receives the on/off command code from the remote transmitter and turns the heater on and off accordingly. Also, the user can turn the heater on/off using an on/off switch at the receiver. When the receiver turns on the fireplace heater, it outputs the fan speed setting to the fireplace fan and the flame height setting to the fireplace heater. When the receiver turns off the fireplace heater, it turns off the fan as well.

The above-described remote control system includes a safety feature built-in to the remote transmitter. This safety feature is a child proof safety feature designed to prevent unintended operation of the remote transmitter, and hence of the fireplace system. A switch 30, preferably arranged inside the back of the remote transmitter's housing 20, is used to switch the operation of the remote transmitter on and off. When the user switches the switch 30 to the off position, the microprocessor 14 in the transmitter will not operate in response to the actuating keys 22. A more detailed description of the operation of the child proof feature will be discussed below.

The fireplace system described above also includes an over temperature protection circuit arranged in the receiver. The over temperature protection circuit 32 (FIG. 7) operates to turn off the fireplace heater and fan when the temperature detected at the receiver is above a maximum temperature. Further details of the over temperature protection circuit will be described below.

Another feature incorporated into the remote control system described above is that an automatic shut-off operation can be performed. For example, when the receiver turns on the fireplace heater but does not receive a command code from the remote transmitter for a certain period of time, the receiver automatically turns off the fireplace heater.

In accordance with the present invention, the remote control system includes certain safety features briefly discussed above. These safety features are incorporated into the system in order to prevent accidents from occurring.

In order to prevent unintentional operation of the remote control system, and hence the operating system to be controlled such as a fireplace, a safety feature in the form of an on/off switch 30 is built into the remote transmitter. The use of such a switch 30 will prevent the unintentional operation of the fireplace, especially by children.

Figure 4:
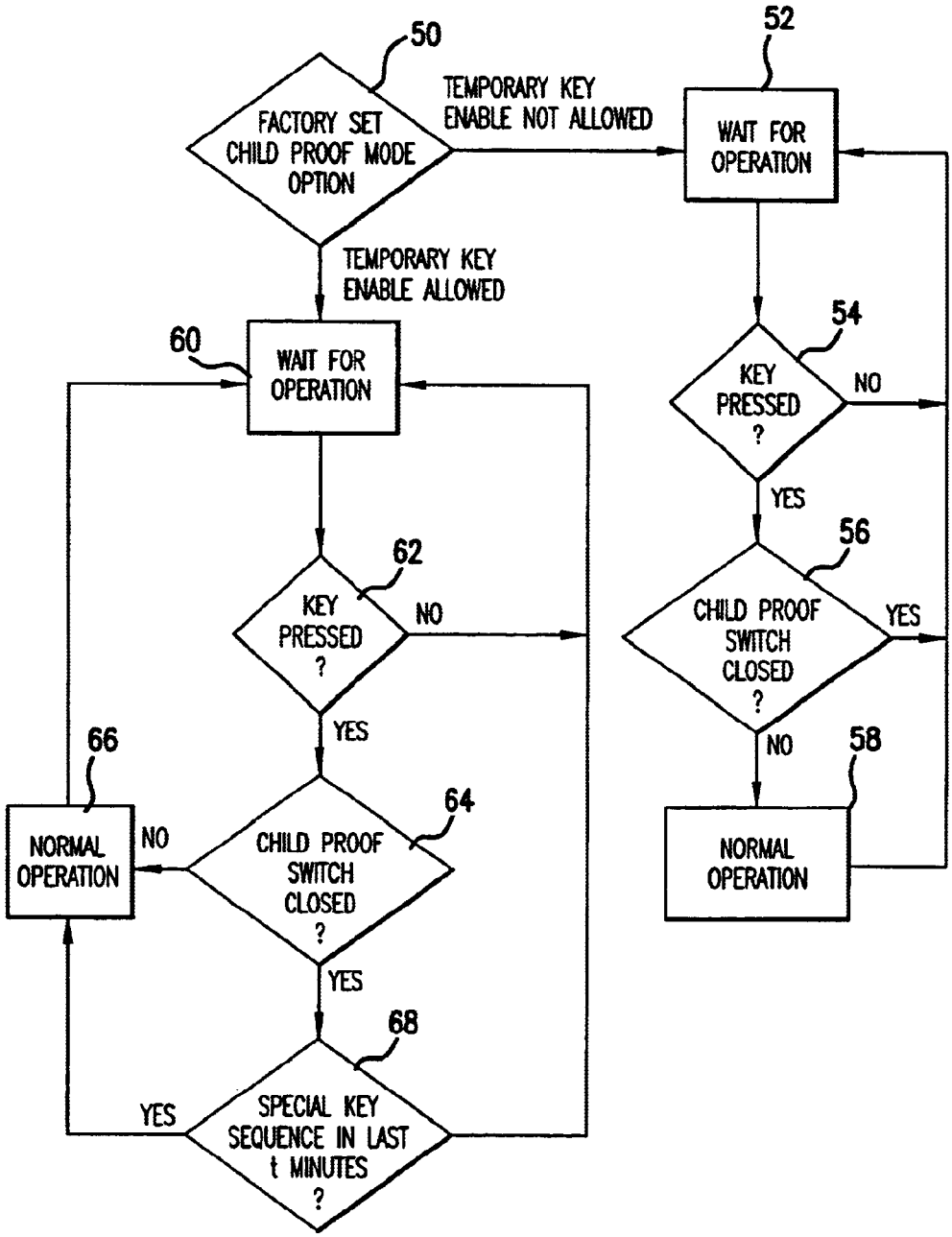
FIG. 4 is a flow chart illustrating the operation and software procedure for child proof protection in a particular embodiment according to the present invention.

Referring to FIG. 4, there is shown a flow chart for the software processing used to implement the child proof feature. The software operates to first read the position of the switch 30. If the switch 30 is open, the remote transmitter operates normally. If, however, the switch 30 is closed, the remote transmitter does not respond to any key 22 that is pressed. This operation is shown in the flow chart on the right side of FIG. 4. A factory set child proof mode option 50 may be provided. If so, the system may allow a temporary key to be enabled. When not allowed, the system waits for an operation at step 52. During this step 52, the actuation of the key does not result in generating a command signal. Rather, the software determines whether a key is pressed at step 54. If not, then the system continues to wait for operation 52. If a key has been pressed at step 54, then the software determines whether the child proof switch 30 is closed. If not, then the system undergoes normal operation at step 58. If it is, then the system continues to loop until such time as the child proof switch is no longer closed.

On the other hand, if the factory setting option, which allows the user to operate the remote transmitter for a short period of time (T, determined by the software such as 2 minutes) after a special key or key sequence has been pressed (such as an UP-DOWN-DOWN-UP-DOWN activation of UP/DOWN buttons within a set time period) is present, the operation is shown in the left side of FIG. 4. At step 60, the software waits for an operation when the temporary key enable has been allowed. Thereafter, the software determines whether a key is pressed at step 62. If a key has not been pressed, then the system continues to wait for operation. If a key has been pressed on the remote transmitter 10, then the software determines whether the child proof switch is closed at step 64. If not, then normal operation continues at step 66. Otherwise, the software determines whether a special key sequence has occurred within a preceding time interval. If such a special key or key sequence has been pressed, then normal operation continues at step 66. Otherwise, the system continues to wait for operation at step 60.

Figure 3:
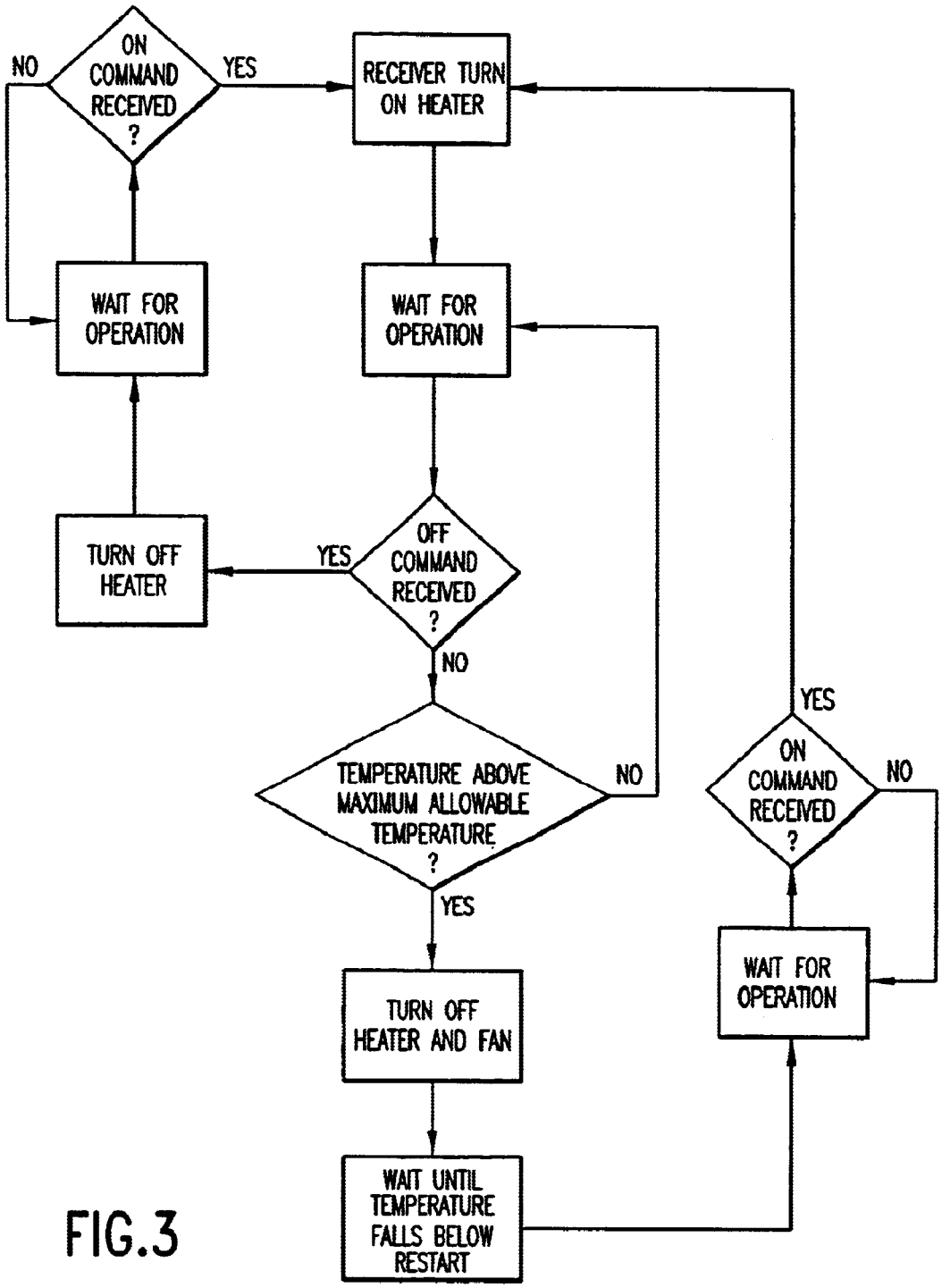
FIG. 3 is a flow chart illustrating the operation and software procedure for overheat protection in a particular embodiment according to the invention.

Referring to FIG. 3, there is shown a flow chart of the receiver over temperature protection feature. A receiver over temperature circuit 32 includes a thermistor 70 (FIG. 7) which senses the temperature in the receiver 12. The microprocessor 16 in the receiver reads from the detection circuit 32 whether the detected temperature is above a maximum allowable temperature, for example, about 60° C. If the temperature is above the maximum allowable temperature, then the microprocessor 16 turns off the heater and fan automatically. Also, the microprocessor 16 will ignore both the remote transmitter RF signal and a manual on/off switch on the receiver. The microprocessor 16 then reads from the electronic circuit 32 whether the temperature falls below a restart temperature, for example, 40° C. If the temperature falls below the restart temperature, then the microprocessor 16 returns to normal operation. The above-described operating sequence is illustrated in FIG. 3.

Figure 5:
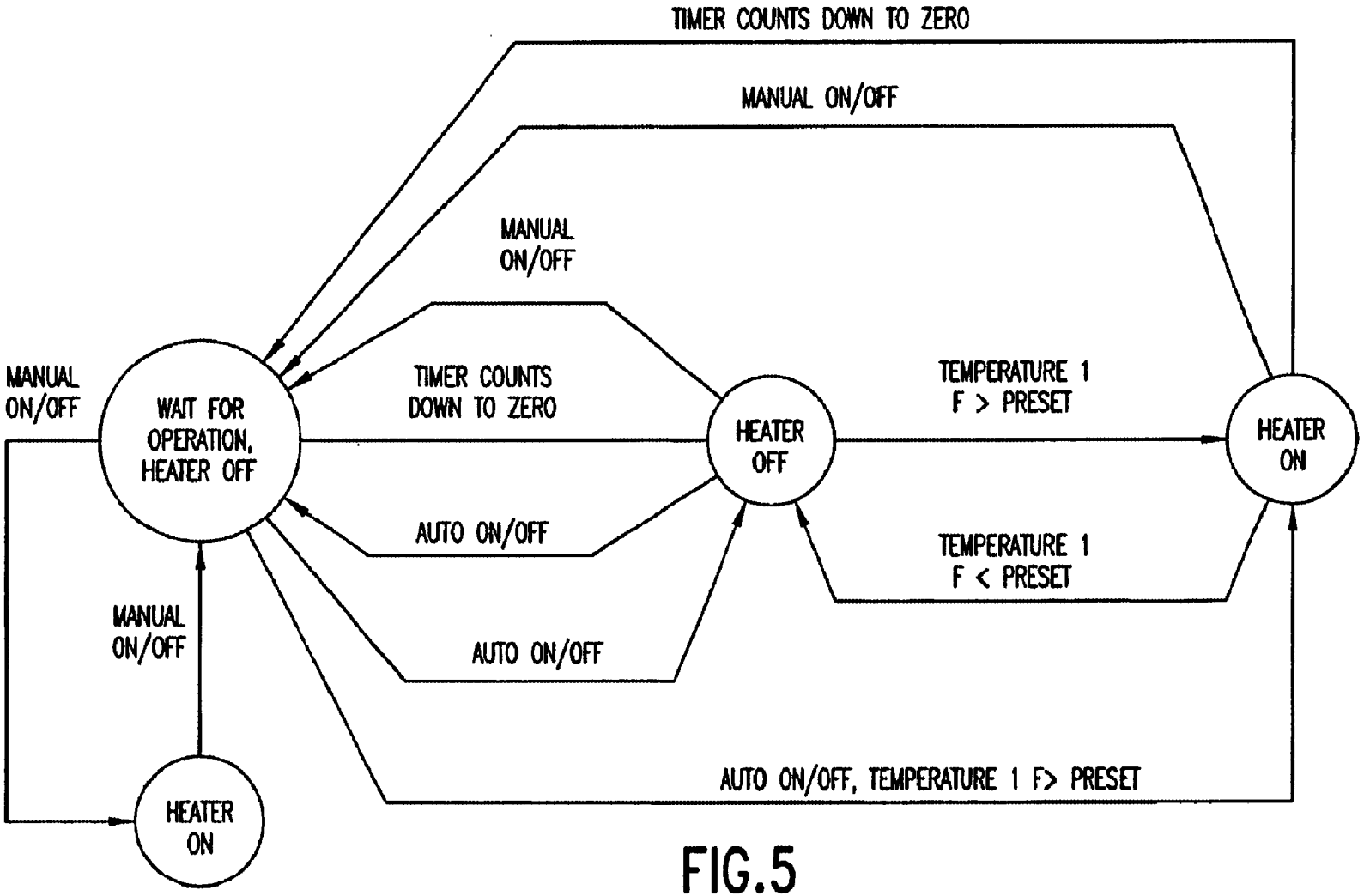
FIG. 5 is a basic functional state diagram according to the present invention.

Referring to FIG. 5, there is shown a basic functional state diagram for operating the fireplace system in general as well as when the remote transmitter operates as a thermostat. The normal operation is shown on the left side of FIG. 5 wherein the fireplace system simply waits for the heater to be manually activated via the remote transmitter or the receiver switch. When a fireplace heater on command is received, the system turns itself on. The right side of FIG. 5 illustrates the operation when the remote transmitter is used as the thermostat. When the ambient temperature is, for example, 1° F. above a preset temperature, the remote transmitter transmits an on command code to the receiver and turns on the fireplace heater. When the ambient temperature is, for example, 1° F. below a preset temperature, the remote transmitter transmits an off command code to the receiver and turns off the heater. The user can also set a timer in order to limit the time of operation. When the timer counts down to zero, the remote transmitter automatically transmits an off command to the receiver to turn off the heater.

Figure 6A:
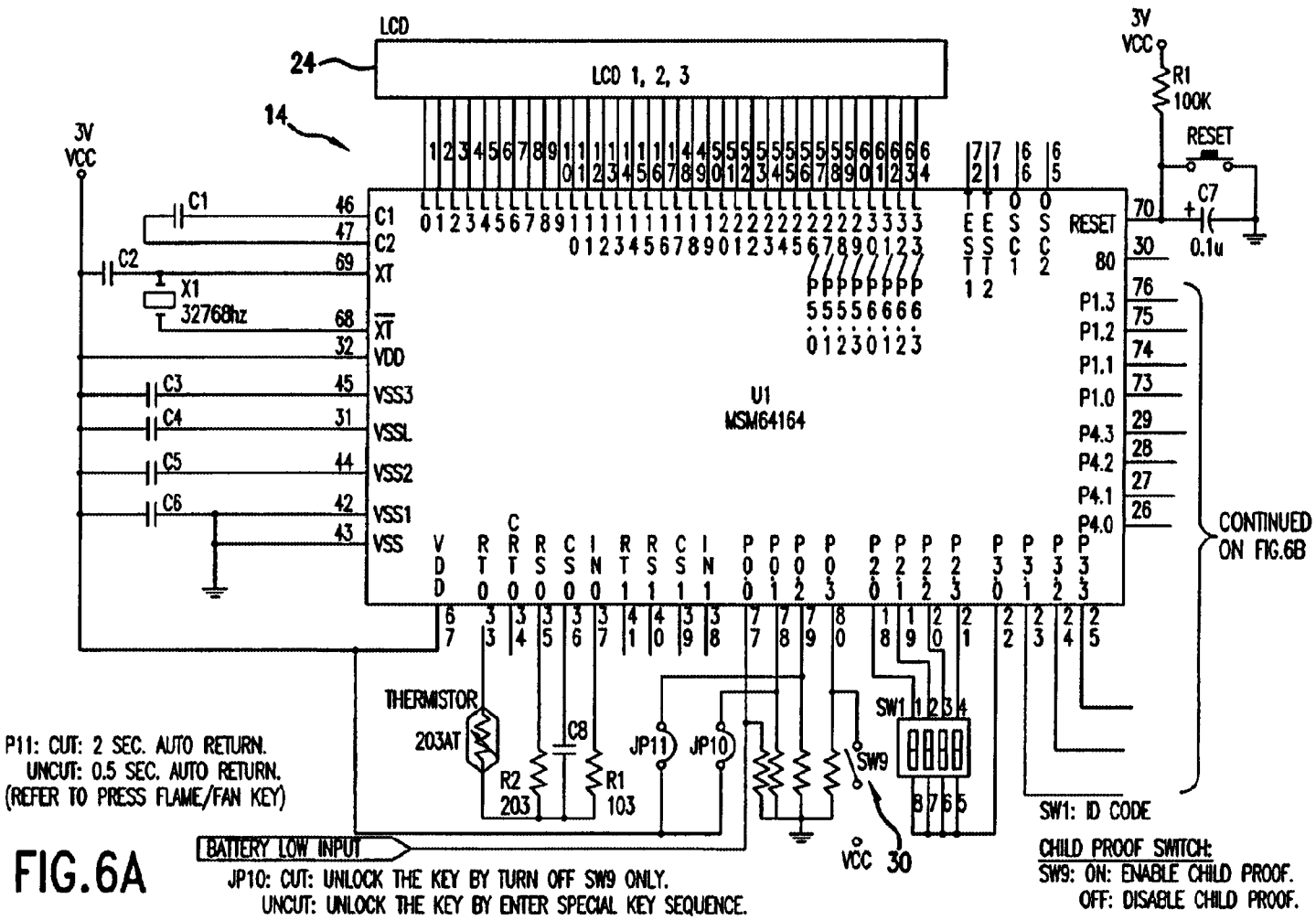
FIG. 6 is a schematic circuit diagram of the remote control system microprocessor for a particular embodiment according to the present invention.
Figure 6B:
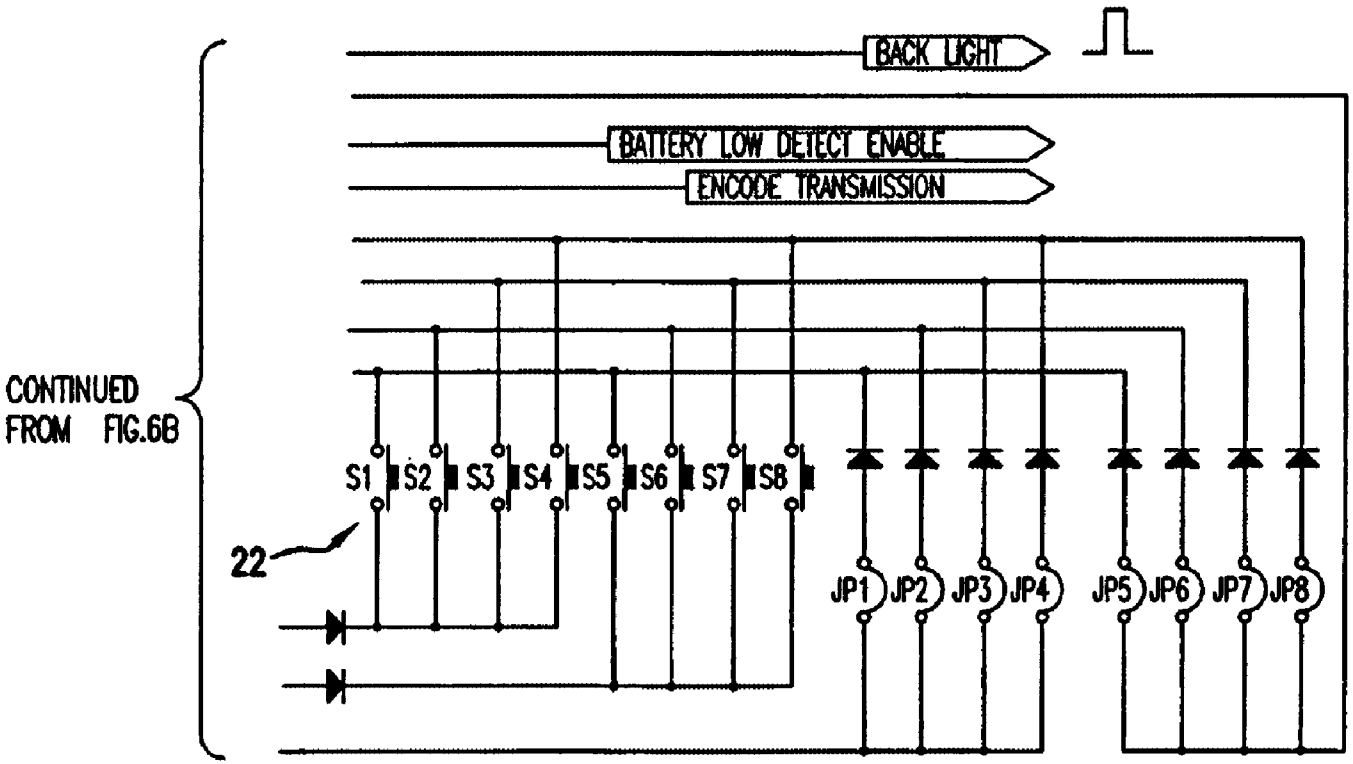
Figure 7:
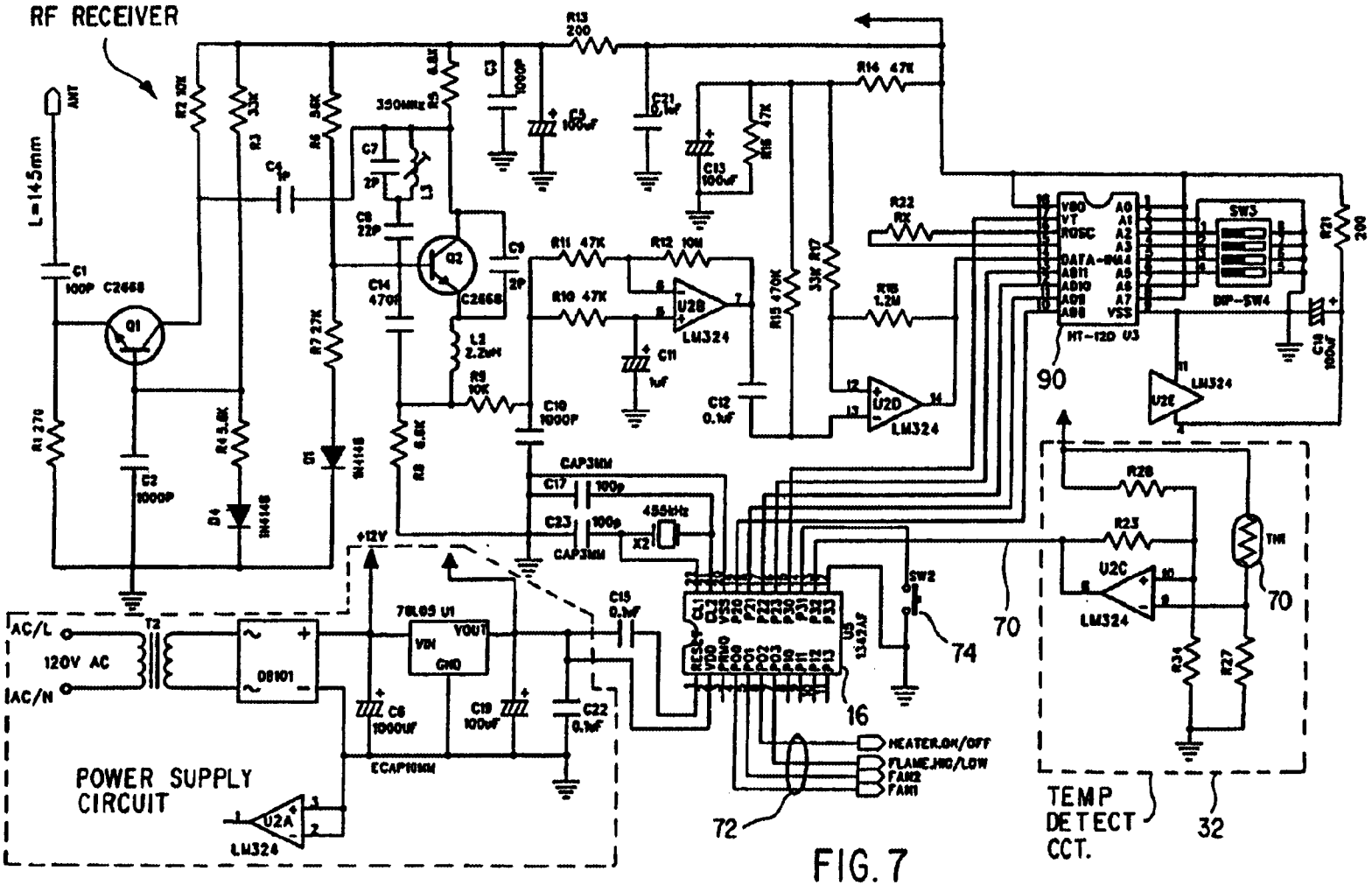
FIG. 7 is a schematic circuit diagram of the remote receiver for a particular embodiment according to the present invention.

Referring to the schematic circuit diagram for the remote transmitter 10 shown in FIG. 6, the microprocessor 14 receives an input from the child proof switch 30 (SW 9) as to whether the child proof feature is activated or not. The microprocessor 14 thus determines if the feature is on or off. When the switch 30 is opened, this indicates that the child proof feature is disabled such that the microprocessor 14 can respond to the actuating buttons (switches 22 (S1–S8)). The microprocessor is also illustrated coupled to the LCD display 24.

If the safety switch 30 is on, then the microprocessor 14 waits for a factory set code to be sent from the actuating buttons 22 (S1–S8) before resuming normal operation. This was described with respect to the left side of the flow chart in FIG. 4. Alternatively, if the safety switch 30 is off, then the transmitter will function normally.

The over temperature protection will be described with respect to the schematic circuit diagram of FIG. 7. The over temperature detection circuit 32 includes the thermistor 70 which senses the room temperature. Signal line 70 provides the detected temperature as an input to the receiver's microprocessor 16. Depending on the detected temperature, the microprocessor outputs signals 72 to control the heater, flame, fan, etc. A reset button 74 is provided to reset the operation of the receiver to override the over temperature control circuit.

As also shown in FIG. 7, the RF receiver (upper left portion of the figure) is a super regenerative receiver. It detects the RF signal (having a typical operating frequency of about 350 MHz) and converts it down to a low frequency (base band) signal. Then, the RF receiver feeds the low frequency signal to a decoder 90. When the decoder 90 receives the low frequency signal it checks it against a private code (discussed with respect to FIGS. 9*a* and 9*b* below) to determine whether the signal is from the remote transmitter or some other transmitter. If the private code matches, then the decoder 90 decodes the low frequency signal and passes it (now as a low frequency signal converted to commands) to the microprocessor 16. Thus, when the processor 16 receives a command, it responds accordingly by controlling the heater, flame, fan, etc.

FIG. 7 also shows in the lower left corner a power supply circuit which operates to convert 120/110 VAC from the power mains to a low voltage direct current DC in order to supply power to the remote receiver circuitry.

Figure 8:
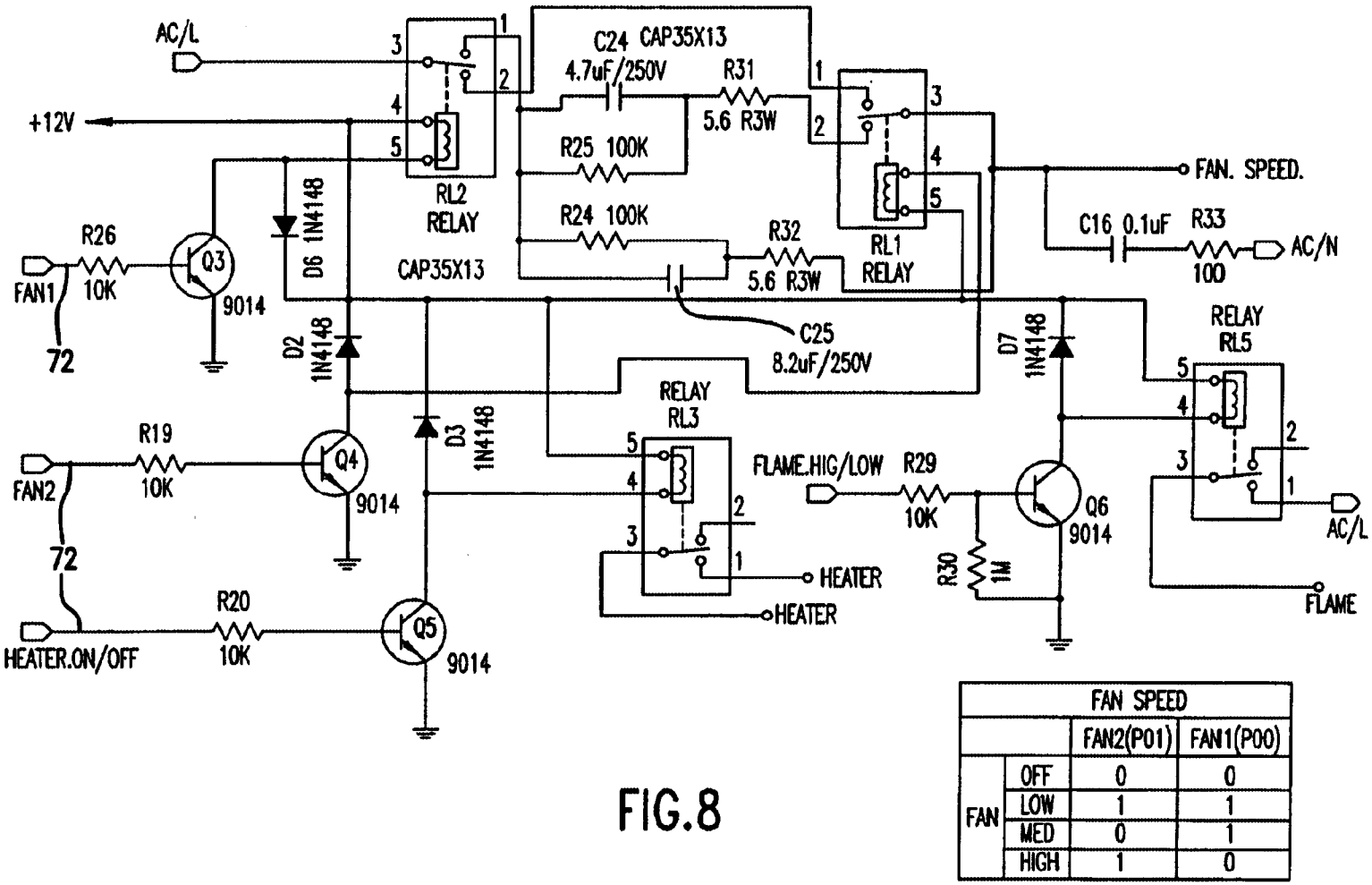
FIG. 8 is a schematic circuit diagram of a remote transmitter for a particular embodiment according to the present invention.

Referring to FIG. 8, there is shown a schematic control circuit having as its inputs the signals 72 to control the heater on/off and fan speed. These signals are processed in order to turn the heater on/off and to adjust the fan speed in accordance with the microprocessor signals.

Figure 9A:
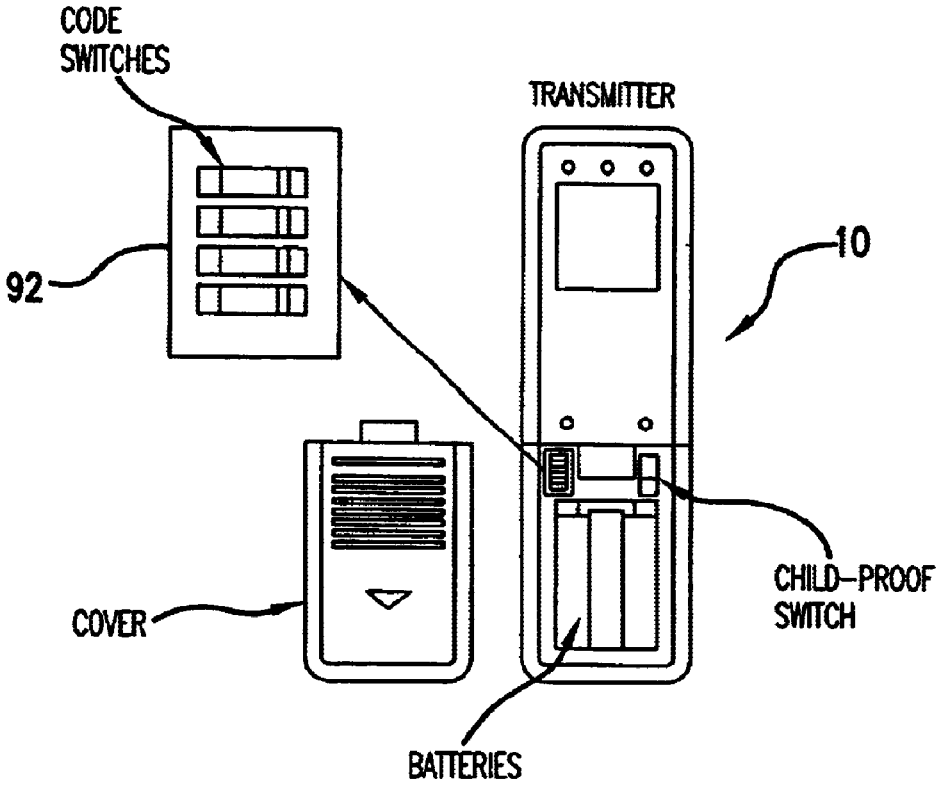
FIGS. 9*a* and 9*b* illustrate the code switches used in the remote transmitter 10 and receiver 12, respectively.
Figure 9B:
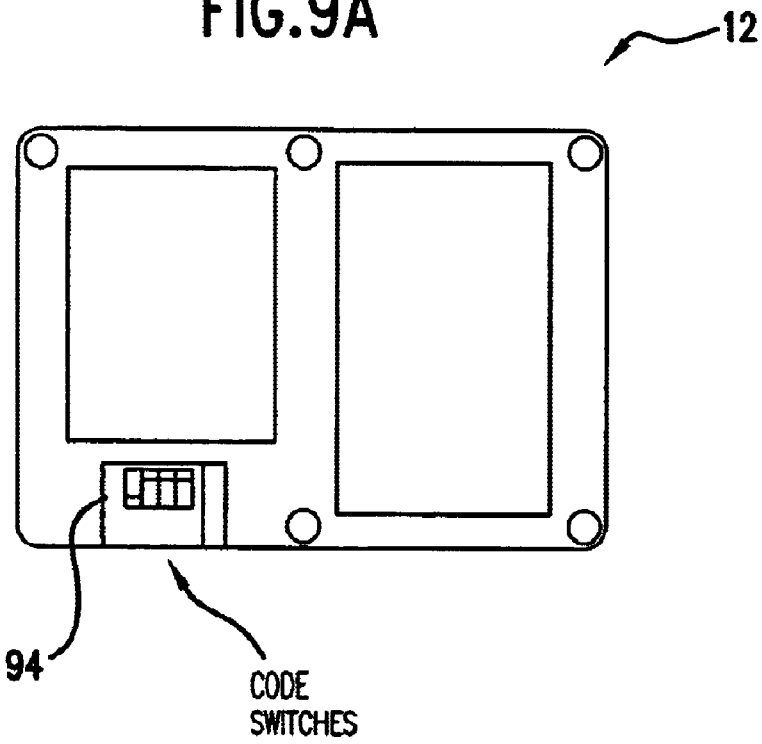

Referring to FIGS. 9*a* and 9*b*, the remote transmitter 10 is shown in an exploded view illustrating codes switches 92 (FIG. 9*a*). Likewise, FIG. 9*b* illustrates corresponding code switches 94 found in the receiver 12. In order to prevent accidental operation of the receiver by other nearby transmitters, the user simply sets the code switches 92, 94 of the transmitter and receiver, respectively, to correspond with one another. As such, only the designated transmitter can appropriately signal the corresponding receiver.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the claims and equivalents thereof.

What is claimed is:

1. A remote control for an operating system, comprising:

a remote transmitter including an actuating device;

a receiver, said remote transmitter being controlled by said actuating device in order to communicate signals to said receiver to control the operating system; and wherein said remote transmitter further includes a child safety toggle switch which is activated by movement from a first fixed position to a second fixed position and which, when activated, deactivates said actuating device, further comprising a child safety switch override system, wherein said child safety switch is deactivated for a predetermined time period upon activation of the override system, wherein said override system comprises a defined key sequence of the remote transmitter.

2. The remote control according to claim 1, wherein said remote transmitter includes a housing, and further wherein said child safety switch is enclosed within said housing such that it is not visible from outside said housing.

3. The remote control according to claim 1, wherein said operating system is a fireplace operating system.

4. The remote control system according to claim 1, wherein said remote transmitter is wirelessly coupled with the receiver.

5. The remote control according to claim 4, wherein said wireless coupling is carried out by one of radio frequency, ultrasonic, and infrared communications.

6. A remote control for an operating system, comprising:

a remote transmitter including an actuating device;

a receiver, said remote transmitter being controlled by said actuating device in order to communicate signals to said receiver to control the operating system; and wherein said remote transmitter further includes a child safety toggle switch which is activated by movement from a first fixed position to a second fixed position and which, when activated, deactivates said actuating device, further comprising a child safety switch override system and, wherein said operating system is a fireplace operating system, further comprising an over temperature control circuit in said receiver, said over temperature control circuit operating to turn off the fireplace operating system when a temperature detected at the receiver is above a maximum temperature.

7. The remote control according to claim 6, wherein the over temperature control circuit operates to turn on the fireplace when the detected temperature falls below a restart temperature.

* * * * *